US006647754B2

(12) United States Patent
Bodnar et al.

(10) Patent No.: US 6,647,754 B2
(45) Date of Patent: Nov. 18, 2003

(54) VARIABLE WIDTH ROLL FORMING APPARATUS

(75) Inventors: Ernest Bodnar, Toronto (CA); Joseph A. Ruckauf, Chicago, IL (US); Gregory C. Nichols, Plainfield, IL (US)

(73) Assignee: Formtek, Inc., Westfield, MA (US)

( * ) Notice: Subject to any disclaimer, the term of this patent is extended or adjusted under 35 U.S.C. 154(b) by 0 days.

(21) Appl. No.: 09/918,747

(22) Filed: Jul. 31, 2001

(65) Prior Publication Data

US 2003/0024290 A1 Feb. 6, 2003

(51) Int. Cl.[7] ..... B21D 5/08
(52) U.S. Cl. ..... 72/181
(58) Field of Search ..... 72/180–182, 176

(56) References Cited

U.S. PATENT DOCUMENTS

| | | | | | |
|---|---|---|---|---|---|
| 1,125,984 | A | * | 1/1915 | Dumas | 72/181 |
| 1,924,333 | A | * | 8/1933 | Talbot | 72/247 |
| 3,348,403 | A | | 10/1967 | W.W. Bartley | 72/248 |
| 3,595,056 | A | | 7/1971 | A.H. Hutton | 72/181 |
| 3,886,779 | A | * | 6/1975 | McClain | 72/181 |
| 3,914,971 | A | * | 10/1975 | Colbath | 72/181 |
| 4,471,641 | A | * | 9/1984 | Mitchell | 72/181 |
| 5,163,311 | A | * | 11/1992 | McClain et al. | 72/181 |
| 5,319,952 | A | | 6/1994 | Cadney | 72/181 |
| 5,787,748 | A | * | 8/1998 | Knudson et al. | 72/181 |
| 5,829,294 | A | | 11/1998 | Bradbury et al. | 72/181 |

* cited by examiner

*Primary Examiner*—Daniel C. Crane
(74) *Attorney, Agent, or Firm*—McCormick, Paulding & Huber LLP

(57) ABSTRACT

A variable width roll forming apparatus forms a web and includes a first side plate extending substantially an entire length of the roll forming apparatus and a second side plate extending substantially an entire length of the roll forming apparatus, the first side plate and the second side plate being oriented substantially equidistant from one another. A plurality of roller die assemblies are disposed in apertures formed in the first side plate and the second side plate. An adjusting apparatus is utilized to selectively change a separation width between predetermined roller die assemblies in the first side plate and the second side plate, wherein the roll forming apparatus defines at least two differing widths between roller die assemblies disposed in the first side plate and the second side plate while maintaining the substantially equidistant spacing between the first side plate and the second side plate.

17 Claims, 5 Drawing Sheets

VARIABLE WIDTH ROLL FORMING APPARATUS

FIELD OF THE INVENTION

The invention relates generally to a variable width roll forming apparatus capable of forming a continuous web of sheet material as the web passes through a plurality of matching die rolls, and more particularly to a variable width roll forming apparatus which is capable of varying the spacing between matching die rolls, as well as compensating for variations in the width of the web.

BACKGROUND OF THE INVENTION

Known roll forming machinery usually has a plurality of sets of roll dies, typically arranged in upper and lower matching pairs, and usually spaced apart along the length of the machine on roller stands. Typically, the roller dies at one stand will produce a continuous formation in the web, and the roller dies of the next stand will produce another formation, or for example increase the angle of the formation which has already been started at the previous stand and so on.

A wide variety of commercial and other products are made on such roll forming machines, such as roof decking siding, as well as a large number of components for consumer equipment. The shapes may simply be webs with edge formations formed along one edge or both, or may be C sections or U sections but in many cases consist of relatively complex formations with longitudinal formations being formed along the length of the web, side by side.

Generally speaking at each stand of rolls there are two lower dies and two upper dies arranged in pairs, on either side of a central web axis to form thereby various bends or shapes in the web. The lower dies engage the underside of the web and the upper dies engage the upper side of the web. The dies have circular shapes, and are mounted on rotatable axles so that the dies can rotate at the same speed as the sheet metal. A gear drive mechanism is coupled to the dies so as to drive them at the speed of the sheet metal.

Each set of such roller dies must be designed to provide a particular formation in the web. In addition, each pair of dies must have a clearance between them determined by the thickness of the web.

Thus, where it is desired to discontinue working on a web of one thickness, and to then run a web of another thickness through the dies, each pair of roller dies must be readjusted to a new clearance, to accommodate the new thickness of the new web. This has typically involved manual manipulation and costly down time in order to make these fine adjustments.

It would therefore be desirable to provide for automatic self-adjustment of the spacing or clearances between the pairs of dies in each stand. However, due to the shaping of the dies there are difficulties in such adjustments. Usually the dies will have two surfaces, one of the surfaces being more or less horizontal, or at least parallel to the plane of the web itself, and the other of the surfaces being at a web-forming angle.

Another set of problems arises if it is desired to use the same roller dies, to form a web having a width which is greater, or narrower than a preceding web.

In the past each of the stands situated on either side of the web would have to be manually moved further apart, or closer together, to take in to account the width of the new web to be processed. However, as will be readily appreciated, it was time consuming to dismantle the arrangement of dies for one web width, and then reassemble the dies with a greater or lesser number of rolls between them to suit the new web width. In addition, this was awkward and time-consuming manual work.

Commonly assigned U.S. application Ser. No. 09/394,309, filed on Sep. 10, 1999, now U.S. Pat. No. 6,282,932, and entitled "Roll Forming Apparatus and Method", discloses several embodiments of a roll forming machine that is capable of quickly adjusting the relative orientation between matching pairs of dies of a given roller stand to accommodate webs of differing gauges, as well as disclosing an automated procedure for moving groups of roller stands, on either side of the webbing, either farther apart or closer together, U.S. application Ser. No. 09/394,309, now U.S. Pat. No. 6,282,932, being herein incorporated by reference in its entirety.

As disclosed in U.S. application Ser. No. 09/394,309 and as illustrated in FIG. 1, the upper roll die 86 in a matching pair of roll dies, 86 and 82 respectively, is secured for rotation within an eccentric sleeve 90 so that rotation of the eccentric sleeve 90 will cause the upper die 86 to move in vertical relationship to its matching lower die 82. More particularly, a plurality of lower die drive shafts 80 are supported by suitable bearings directly in a side plate 38 of the roll forming machine. These drive shafts are driven by a suitable gear train and support lower forming dies 82. Telescoping driven shafts 84 extend from the drive shafts 80 to driven hubs (not shown) rotatably mounted in a matching side plates disposed on the opposing side of the webbing W, and driven shafts 84 extend completely through these driven hubs. The lower forming dies 82 are supported on such driven hubs. In this way the lower forming dies of all of stands in the roll forming machine are driven in unison.

A plurality of upper dies 86 are carried on upper shafts 88. The eccentric bearing sleeves 90 which carry the upper shafts 88 are both slidably and rotatably mounted in the side plate 38. The sleeves 90 define shaft openings 92 which are offset from the central axis of the sleeves 90 for reasons as described below. The upper die shafts 88 are themselves driven by a gear train connected to the lower shafts. As explained above, there is provided means for adjusting at least one of the upper and the lower dies, 86 and 82 respectively, relative to the other, so as to adjust the vertical clearance between the dies, to match the thickness or gauge of the web material W as closely as possible. Such adjustments may be made while the web W is actually running through the dies, thus compensating for variations in the thickness of the web along its length, all of which will be described below.

It will be seen that it is the upper dies 86 that are all adjustable relative to the lower dies 82, which are on fixed axes. However it will be appreciated that the lower dies 82 could be made adjustable while the upper dies 86 remain fixed, should such an architecture be desired.

As explained above each of the upper shaft sleeves 90 have eccentric shaft openings 92 for receiving die shafts 88 and the driven hubs (not shown) in the side plate 38. Each sleeve 90 is supported in a respective opening in the side plate 38.

The sleeves 90 are able to rotate in the side plate 38, in a manner to be described below, and thus cause upward and downward semi arcuate movement of upper die shafts 88 and their dies 86.

The sleeves 90 are also adjustable axially, i.e. horizontally, inwardly and outwardly, this produces what is in the end an adjustment of the upper dies 86 along diagonal axes relative to the web W to accommodate minor variations in the web thickness as it passes both through the horizontally opposed faces of each die pair, as well as through the angularly opposed faces of the die pair.

The mechanism by which this adjustment is achieved is also depicted in FIG. 1. Referring again to FIG. 1, each sleeve 90 is connected to a semi arcuate eccentric arm 60. Two bolts 62 pass through arcuate slots 64 in the arm 60 and are bolted into the sleeve 90. The eccentric arm 60 is formed with a pair of upwardly directed guides 66 which define a U shaped slot. An adjustment pin 68 is received in the U shaped slot of the guides 66. The pin 68 extends sideways from an adjustment or draw bar 61 which extends along the top of the side plate 38. The identical structure is provided for the opposite sleeve (not shown) which is mounted in the side plate on the opposing side of the web W. As would be appreciated, an identical draw bar will extend along the top of the non-illustrated matching side plate.

The pins 68 are located at spaced intervals along the draw bar 61 at spacings corresponding to the locations of the sleeves 90. A suitable power mechanism (not shown) at one end of bar 61 pushes or pulls it to provide the adjusting movement. As the bar 61 moves it will force the pin 68 located between the guides 66 to rotate the arm 60 through a small angular extent, an arc of one or two degrees in most cases being sufficient. This will in turn force the rotation of the sleeve 90 through the same arc. Since the sleeve 90 carries the die shaft 88 off center in an eccentric manner, the shaft 88 will swing upwardly or downwardly a fractional amount, which will be sufficient to adjust for the variations in thickness of the web.

This explains the vertical, transverse adjustment of the upper die 86 relative to the lower die 82.

A horizontal adjustment along the shaft axis is also provided by the mechanism depicted in FIG. 1. This is produced by a cam block 67 secured to the side plate 38 and the cooperating roller 63 which is bolted to the arm 60.

The block 67 is formed with a generally diagonal slot 65, which receives the roller 63. When the arm 60 is moved by the pin 68 so as to produce the small angular adjustment, it also causes the roller 63 to move along the slot 65. The axis of the slot 65 is angled along a diagonal axis so that the roller 63 must move along that angled axis. This will cause the arm 60 to move towards or away from the side plate 38. The sleeve 90 to which the arm 60 is attached will thus be forced to slide into or out of the plate 38. Again, the actual degree of movement is slight, but it is sufficient to produce the adjustment in die clearance required to accommodate variations in the web thickness.

Therefore, movement of the arm 60 caused by the roller 63 and the slot 65 will cause the guides 66 to slide outwardly or inwardly relative to the pin 68, but again the degree of movement will be slight. It will thus be seen that by this mechanism movement by the single draw bar 61 will cause simultaneous movement of the sleeve 90 both transverse to its axis and also axially along its axis, that is, both vertically and horizontally with respect to the lower die 82 and the side plate 38. These two degrees of movement will translate into movement of the upper die 86 along a diagonal axis relative to the lower die 82. The bolts 62 can be loosened, and the arm 60 can be adjusted by sliding the slots 64 relative to the bolts which can then be tightened once more. This enables the machine to be set up prior to operation to the optimum die clearance for a particular thickness of web. It will be readily appreciated that a more complete operational understanding of the mechanism depicted in FIG. 1 may be ascertained by a review of U.S. application Ser. No. 09/394,309 which, as discussed previously, has been incorporated by reference in its entirety.

As described above in conjunction with FIG. 1, changes in web thickness or gauge may be readily accommodated utilizing an eccentrically aligned upper (or lower) roll die in concert with a camming arrangement, while gross changes in the width of the web itself may be compensated for through the use of a drive mechanism which acts to shift one of the many opposing side plates either away or towards one another, as necessary, thereby selectively adjusting the width of specified portions of the roll forming apparatus.

It is important to note, however, that a roll forming apparatus as described above will typically be comprised of several, operationally integrated stations, or sets of die stands, which are housed within a matching plurality of respectively separate side plates on either side of the moving web. Such a configuration is necessary to enable differing stations of the roll forming apparatus to be arranged to accommodate a web of differing widths as the web travels the length of the roll forming apparatus. Thus, the roll forming apparatus typically requires a separate set of opposing side plates for a first station set at a first width, another set of opposing side plates for a second station set at a second width, yet another set of opposing side plates for a third station set at a third width, and so on, so as to accommodate the changing width of the web as it travels the length of the roll forming apparatus.

A major drawback, therefore, of the roll forming apparatus described above is that a single side plate on either side of the web typically cannot be employed, and as such, the rigidity and stability of the apparatus as a whole is lessened. Moreover, by stringing together separate stations of the roll forming apparatus, each with their own opposing pairs of side plates, the complexity of the alignment, as well as the complexity of the coordination, of these stations is greatly increased.

OBJECTS AND SUMMARY OF THE INVENTION

It is an object of the present invention to configure a roll forming apparatus which exhibits greater rigidity and stability.

It is another object of the present invention to configure a roll forming apparatus having a single pair of opposing side plates disposed along the entire length of the roll forming apparatus.

It is another object of the present invention to manipulate the separation width between selected pairs of die stands, exclusive of shifting the entirety of the opposing sides plates.

It is another object of the present invention to manipulate the separation width between selected pairs of die stands, exclusive of shifting the entirety of the opposing sides plates, while still maintaining the desired relationship between the upper and lower die pairs.

According to one embodiment of the present invention, a variable width roll forming apparatus for progressively forming a web of material directed therethrough includes a first side plate extending substantially an entire length of the roll forming apparatus and a second side plate extending substantially an entire length of the roll forming apparatus, the first side plate and the second side plate being oriented on opposing sides of an axis of movement of the web and substantially equidistant from one another. A plurality of roller die assemblies are disposed in apertures formed in the first side plate and the second side plate. An adjusting apparatus is utilized to selectively change a separation width between predetermined roller die assemblies in the first side plate and the second side plate, wherein the roll forming apparatus defines at least two differing widths between roller die assemblies disposed in the first side plate and the second side plate while maintaining the substantially equidistant spacing between the first side plate and the second side plate.

These and other objectives of the present invention, and their preferred embodiments, shall become clear by consideration of the specification, claims and drawings taken as a whole.

DETAILED DESCRIPTION OF THE PREFERRED EMBODIMENT

Figure 2:
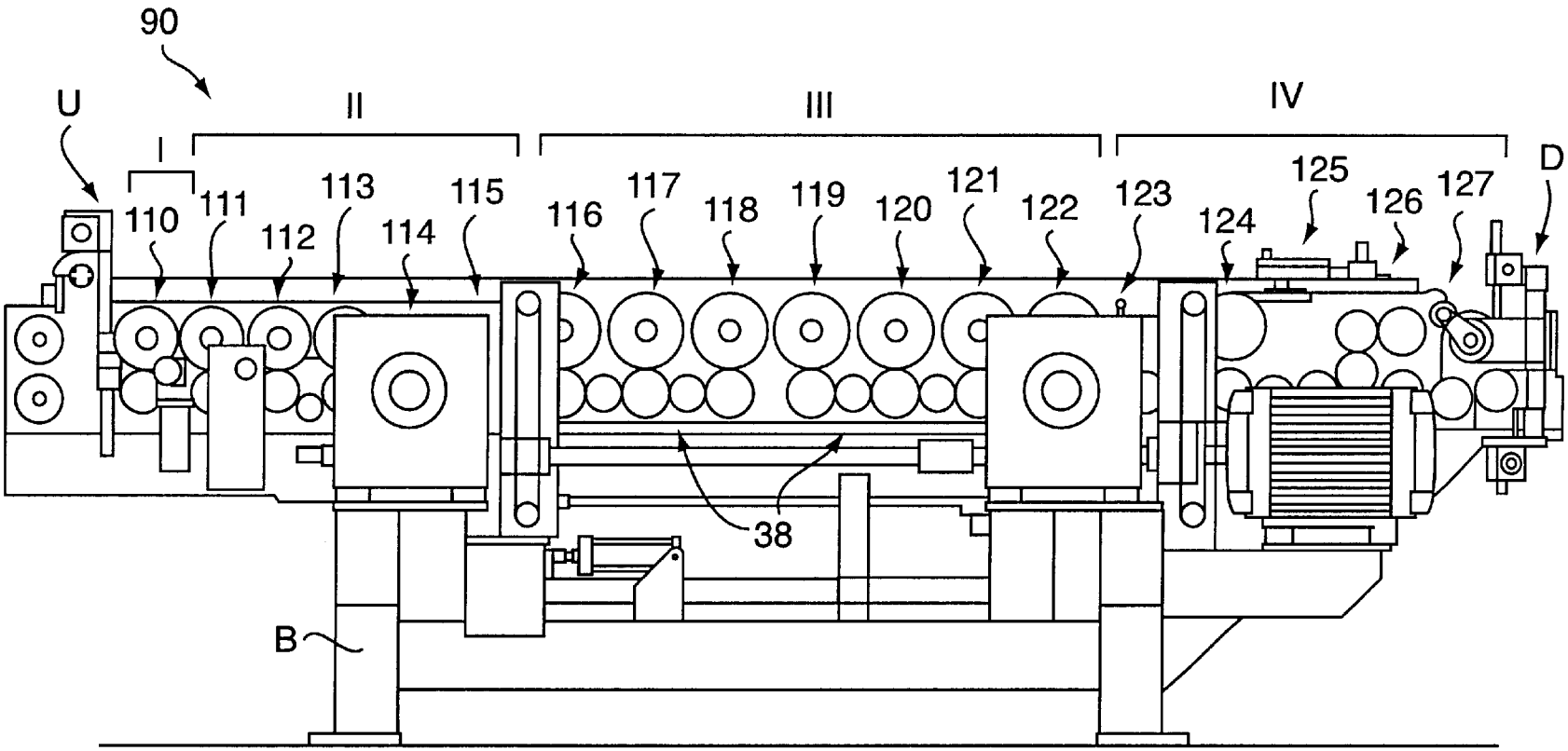
FIG. 2 is an exterior side view of a variable width roll forming apparatus, according to one embodiment of the present invention.

FIG. 2 illustrates an exterior side view of a variable width roll forming apparatus 90, according to one embodiment of the present invention. As depicted in FIG. 2, the roll forming apparatus comprises a base indicated generally as B, defining an upstream end U, and a downstream end D, and the web sheet metal passes from left to right, from the upstream end U, to the downstream end D, continuously, while being progressively roll formed.

Roll forming of the web is performed progressively at a series of roller die stands indicated generally as 110, 111, 112, 113, 114, 115, 116, 117, 118, 119, 120, 121, 122, 123, 124, 125, 126, and 127. The stands are mounted on the base B, in a manner to be described, at spaced apart intervals along the path of the web. The roller die stands are mounted in five groups: Group I, comprised of stand 110, is the lead in or pinch roll section where the flat web is gripped and driven along the path to the rest of the rolls; Groups II, comprised of stands 111, 112, 113, 114 and 115, and III, comprised of stands 116, 117, 118, 119, 120, 121, and 122, are forming dies which function to form the progressive bends in the web. Groups IV and V, comprised of stands 123, 124, 125, 126 and 127, perform finishing and straightening actions. It will be readily appreciated that stands 110–127 each comprise a pair of roller dies situated on either side of the web. That is, stand 110 comprises dies 110A and 110B on opposing sides of the web, stand 111 includes 111A and 111B on opposing side of the web, and so on. Moreover, each stand, for example 110A and 110B, are themselves comprised of matching upper and lower dies for contact with the upper and lower planes of the web, respectively.

As was discussed previously, it has been known to mount one or more of the stand Groups I, II, III, IV and V through separate side plates along each side of the roll forming apparatus 90. In contrast to this known configuration, the present invention mounts all of the matching upper and lower dies, for each of the stand Groups I, II, III, IV and V, on one side of the roll forming apparatus 90 through a continuous side plate 38. The counterpart matching upper and lower dies for each of the stand Groups I, II, III, IV and V are themselves mounted through a similar continuous side plate 40 (illustrated in FIG. 3).

Figure 3:
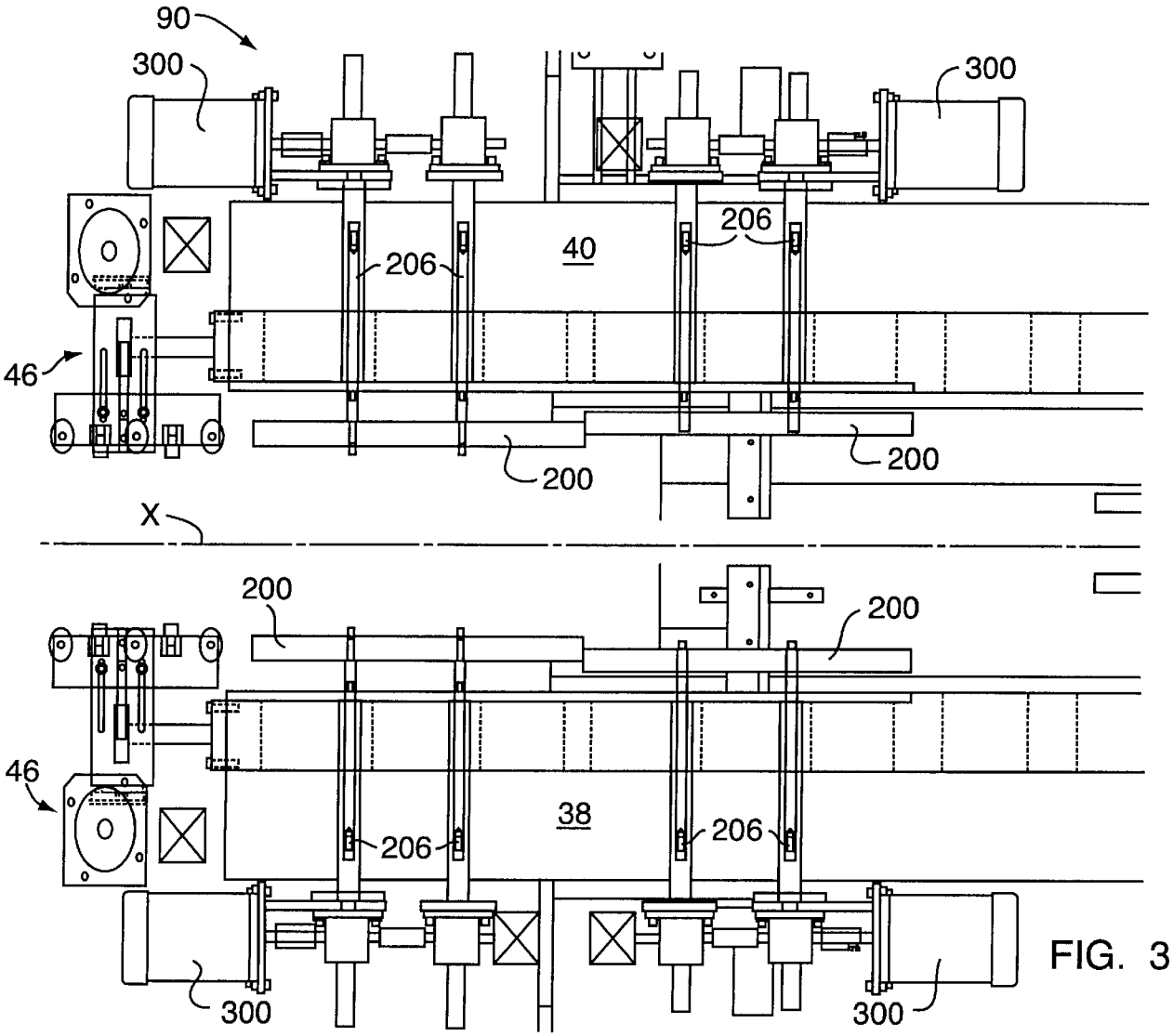
FIG. 3 is a top, partial cross-sectional planar view of the variable width roll forming apparatus depicted in FIG. 1.

Turning to FIGS. 2 and 3 in combination, it will be readily appreciated that by mounting the upper and lower dies on each side of the roll forming apparatus 90 to a separate and continuous side plate 38/40, the distance separating the side plates 38 and 40 may be adjusted, along the entire length of the roll forming apparatus 90, with a single movement of either the side plate 38 or the side plate 40. As depicted in FIG. 3, a transverse power drive means 56 operates to move the plates 38 and 40 together or apart, as necessary, to accommodate webs of varying widths. The transverse power drive means 56 may be comprised of any known drive mechanism, such as a rotary encoder or the like, without departing from the broader aspects of the present invention.

It is therefore an important aspect of the present invention that the roll forming apparatus 90 need not coordinate the movement and positioning of several different side plates on each side of the roll forming apparatus 90 during operation, thereby making both the manufacture and operation of the roll forming apparatus 90 less expensive and less complex. Moreover, by having a single side plate 38/40 on each side of the roll forming apparatus 90, the present invention is significantly more rigid and therefore less susceptible to the warping and bending stresses experienced by the roll forming apparatus 90 during normal operation.

While providing certain advantageous benefits as enumerated above, the single side plate construction of the roll forming apparatus 90 initially restricts the roll forming apparatus 90 to define a uniform separation distance between matching die stands on either side of an axis of movement X of the web. As was explained previously, it is oftentimes necessary to orient a given station or Group of the roll forming apparatus 90 to have a differing separation distance, or width, than the station either preceding or following the given station or Group. The present invention utilizes a number of collector plates 200 for this purpose.

Figure 4:
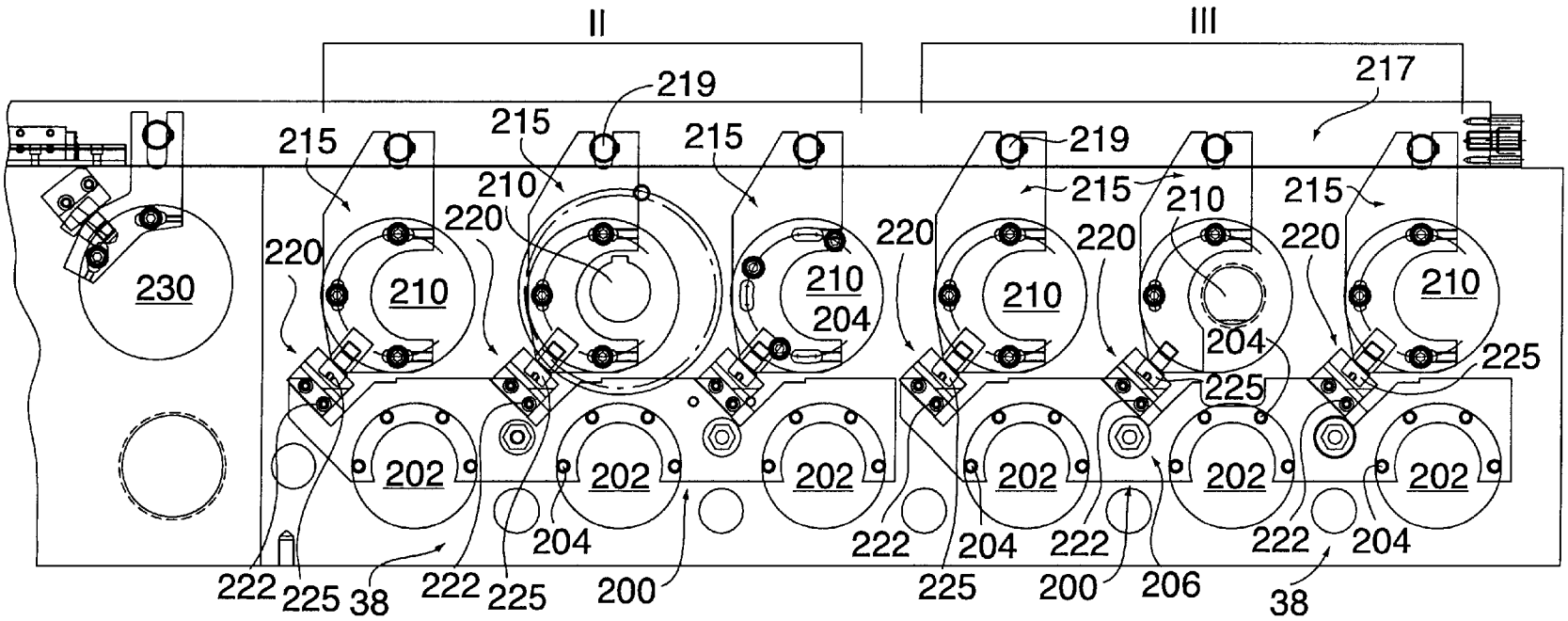
FIG. 4 is a partial interior elevational view of the variable width roll forming apparatus depicted in FIG. 1.

FIG. 4 is a partial interior side view of the roll forming apparatus 90, illustrating the use of the collector plates 200, according to one embodiment of the present invention. As depicted in FIG. 4, a plurality of lower dies of, for example, Groups II and III are fixed to separate collector plates 200. As is disclosed in U.S. application Ser. No. 09/394,309 and herein incorporated again by reference in its entirety, the lower dies 202 are each mounted within a sleeve which, in turn, is mounted within the side plate 38 (40). Each of the sleeves themselves are provided with bearings or the like and are capable of axial movement relative to the side plate 38(40). The collector plates 200 are secured to the sleeves of the lower dies 202 via a plurality of bolts 204 or the like and are themselves secured to the side plate 38(40) by one or more jack screws 206.

As depicted in FIG. 4, operation of the jack screws 206 in a first direction will cause movement of the collector plates 200 in a direction away from the planar surface of the side plate 38(40), while operation of the jack screws 206 in a second direction will cause movement of the collector plates 200 in a direction towards the planar surface of the side plate 38(40). As will be appreciated, the sleeves of the lower dies 202 will move in a rectilinear and axial direction, in concert with the movement of the collector plates 200.

Thus, it is another important aspect of the present invention that the collector plates 200 enable the roll forming apparatus 90 to selectively control the effective spacing between die stands housed within either the side plate 38 or and the side plate 40. In this manner, the roll forming apparatus 90 is capable of accommodating a web whose width varies as the web is fed through the roll forming apparatus 90, while still maintaining the rigidity of the roll forming apparatus 90 as a whole.

Of course, while movement of the collector plates 200 will cause a corresponding axial displacement of the lower dies 202 which are fixed to the collector plates 200, the matching upper dies 210 must also be shifted horizontally, or axially, in order to remain in alignment with the displaced lower dies 202. Towards this end, the present invention utilizes a cam block and eccentric arm arrangement similar to the one described in conjunction with FIG. 1.

Each of the upper matching dies 210 in FIG. 4 are carried on an upper shaft housed within an eccentric bearing sleeve, and are both slidably and rotatably mounted in the side plate 38. The sleeves define shaft openings which are offset from the central axis of the sleeves so that rotation of the upper sleeves causes a corresponding displacement of the upper dies in a vertical direction, either away or towards the lower dies 202.

Figure 1:
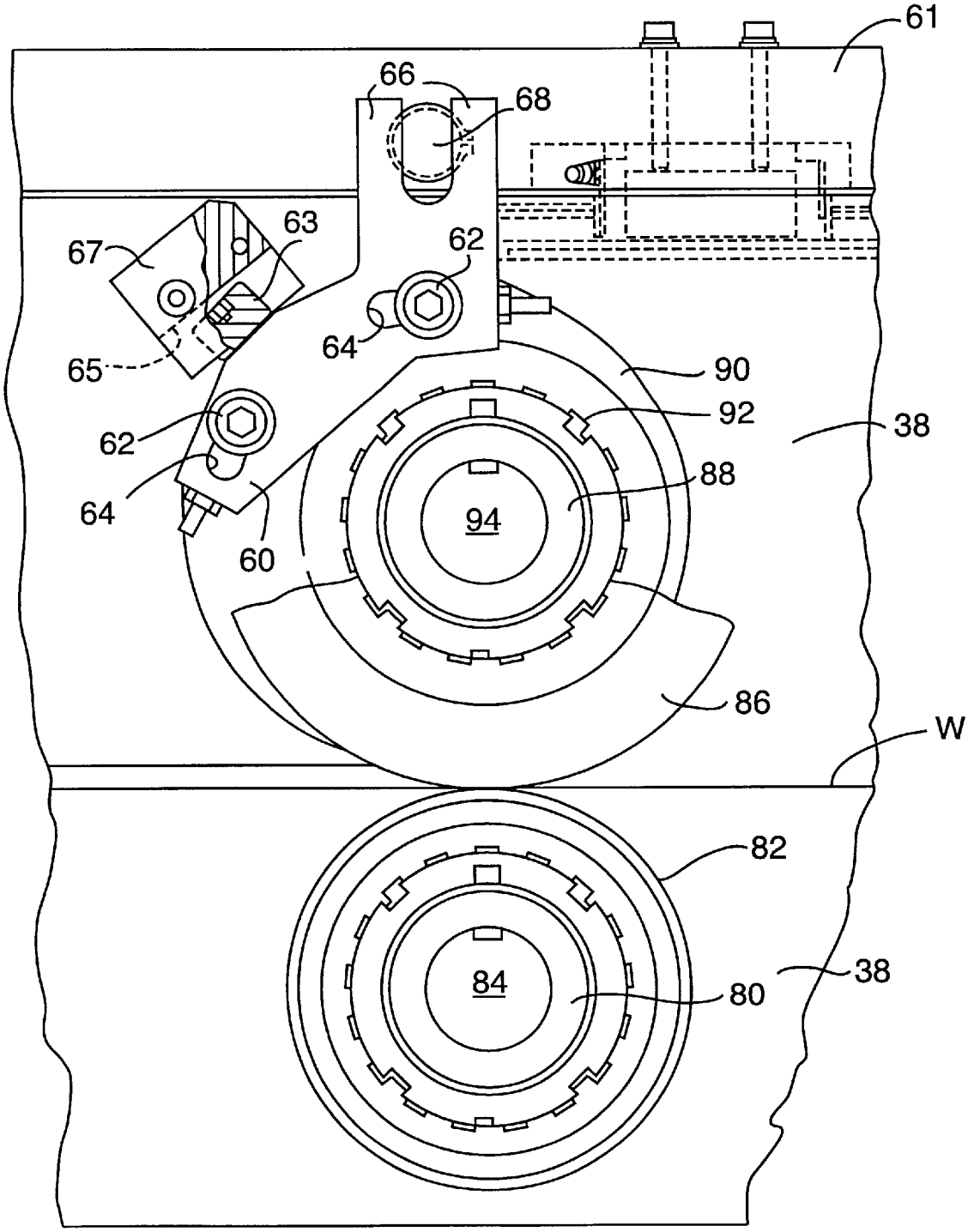
FIG. 1 PRIOR ART
FIG. 1 is a partial cross-section, elevational view of a known adjustment device for an upper and lower die arrangement.

While the present invention utilizes an eccentric arm 215 fixed to the upper sleeves and controlled by the interaction between a draw bar 217 and associated draw pins 219 to produce the desired rotation of the upper sleeves, similar to the arrangement depicted in FIG. 1, the present invention selectively mounts a plurality of adjustment blocks 220 to the collector plates 200 via bolts 222, not to the side plate 38(40). With such a configuration, as the collector plates 200 are shifted by operation of the jack screws 206, the blocks 220 are themselves carried either away or towards the side plate 38(40). The ensuing interplay between the generally diagonal slot formed in the block 220, and the cam roller 225 which is fixed to the arm 215, causes a corresponding horizontal, or axial, movement of the upper dies 210.

It is therefore another important aspect of the present invention that movement of the collector plates 200 not only operates to shift a selected number of lower dies 202 in a horizontal, or axial, direction, but also precipitates an equal displacement of the matching upper dies 210. In this manner, the present invention ensures that the upper and lower dies, 210 and 202 respectively, will remain in proper registration with one another regardless of the movement of the collector plates 200. Moreover, the roll forming apparatus 90 of the present invention maintains the ability to adjust the vertical displacement between the upper and lower dies, 210 and 202 respectively, via the draw bar 217 in order to compensate for webs of differing gauges.

While FIG. 4 depicts three lower dies 202 being connected by each of the collector plates 200, the present invention is not limited in this regard as one or more lower dies 202 may be selectively secured to the collector plate 200 for axial movement, through operation of the jack screws 206, without departing from the broader aspects of the present invention. It is this flexible nature of the collector plates 200, that is, the selective implementation of the collector plates 200 at specified locations along the length of the roll forming apparatus 90, which is another important aspect of the present invention. As depicted in FIG. 4, while the collector plates 200 are shown as tying selected lower dies 202 of Groups II and III together, the present invention may be easily integrated, and selectively interspersed, with upper dies 230 which are not fixed to a collector plate 200 and which retain the block and eccentric arm configuration as depicted in FIG. 1.

Returning to FIG. 3, the selective implementation of the collector plates 200 is shown. As depicted in FIG. 3, the operational width of the roll forming apparatus 90 may be selectively adjusted via operation of the jack screws 206 under the control of a motor and encoder device 300. While FIG. 3 illustrates a separate motor and encoder device 300 for each side of a given die stand, the present invention is not limited in this regard as a common motor and encoder device, with an associated gear train, may be alternatively utilized to control the horizontal movement of the collector plates 200 for each side of a die stand without departing from the broader aspects of the present invention.

Figure 5:
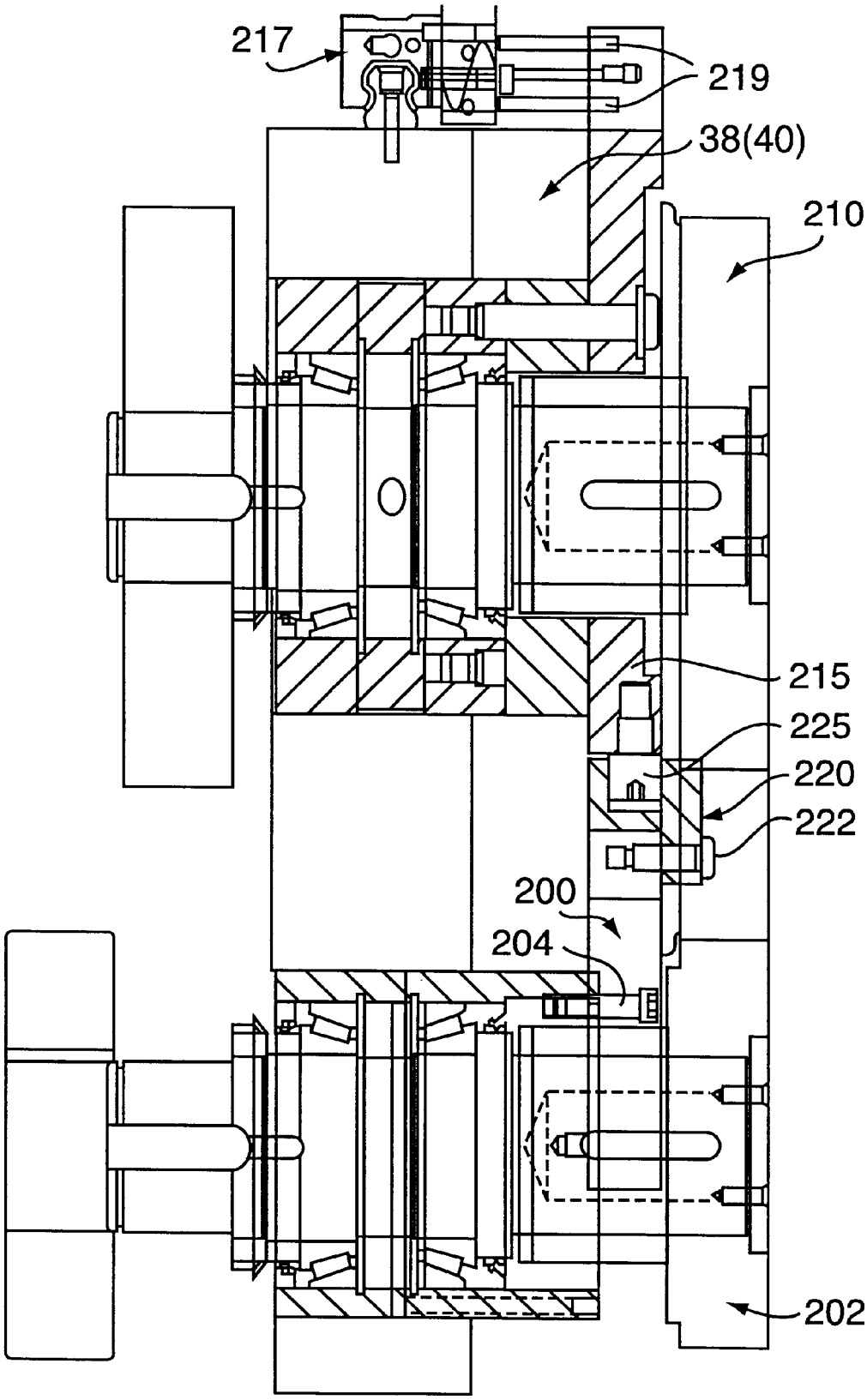
FIG. 5 is a partial cross-sectional view of an upper and lower matching die pair according to one embodiment of the present invention.

FIG. 5 depicts a partial cross-sectional view of an upper and lower matching die pair, 210 and 202 respectively, of the roll forming apparatus 90. As illustrated in FIG. 5, the orientation of the collector plate 200, as well as other components of the roll forming apparatus 90, is shown.

In consideration of FIGS. 2–5 and their associated descriptions contained herein, it will be readily appreciated that the variable width roll forming apparatus 90 of the present invention is capable of providing a range of dimensional adjustments to the roll forming apparatus 90 heretofore unknown in the art, such as: Gross width adjustment as controlled by the selective movement of the single side plates 38 and 40; Selective width adjustment of predetermined stations or Groups of die stand(s) oriented along the roll forming apparatus 90 via the inclusion and operation of specified collector plates 200, all while maintaining a proper alignment between the upper and lower dies as they are axially shifted by the collector plates 200, and; Clearance adjustment between all upper and lower matching dies to accommodate webs having differing gauges, via the draw bar 217 and eccentric arm 215 arrangement.

Moreover, as has been previously mentioned, the present invention derives great rigidity and stability by utilizing a single side plate configuration, thereby leading to less operational failure of the roll forming apparatus 90, as well as ensuring greater structural integrity, that is, less warping or bowing, of the formed web. Additional advantageous benefits resulting from the use of a single side plate configuration are the elimination of many parts, and the associated costs, inherent in the manufacture, maintenance and integrational alignment of a roll forming apparatus having a plurality of separately moveable units, each of which includes their own set of opposing side plates. The present invention thereby permits the disclosed variable width roll forming apparatus to be smaller and more compact in design.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A method for adjusting an axial displacement of a roller die assembly of a roll forming apparatus relative to a side plate through which said roller die assembly is housed, said roller die assembly comprising a first die assembly and a second die assembly configured to receive a web therebetween, said method comprising the steps of:

securing a collector plate to only one of said first die assembly and said second die assembly;

operatively linking said collector plate to said side plate via a drive mechanism;

selectively operating said drive mechanism to move said collector plate in an orthogonal direction to said side plate, wherein said drive mechanism operates to move said collector plate without rotation of said first die assembly and said second die assembly; and moving one of said first die assembly and said second die assembly not secured to said collector plate in registration with said movement of said collector plate.

2. The method for adjusting an axial displacement of a roller die assembly according to claim 1, said method further comprising the steps of:

controlling said drive mechanism with a motor and an encoder device.

3. The method for adjusting an axial displacement of a roller die assembly according to claim 1, said method further comprising the steps of:

securing said collector plate to one of a third die assembly and a fourth die assembly of said roller die assembly, said third die assembly and said fourth die assembly being configured to receive a web therebetween.

4. The method for adjusting an axial displacement of a roller die assembly according to claim 3, said method further comprising the steps of:

moving one of said first die assembly and said second die assembly not secured to said collector plate in registration with said movement of said collector plate; and moving one of said third die assembly and said fourth die assembly not secured to said collector plate in registration with said movement of said collector plate.

5. A method for adjusting an axial displacement of at least two roller die assemblies of a roll forming apparatus relative to a side plate through which said roller die assemblies are housed, each of said roller die assemblies comprising an upper die assembly and a lower die assembly configured to receive a web therebetween, said method comprising the steps of:

securing a collector plate to only one of said upper die assemblies and said lower die assemblies;

operatively linking said collector plate to said side plate via a drive mechanism;

selectively operating said drive mechanism to move said collector plate in an orthogonal direction to said side plate, wherein said drive mechanism operates to move said collector plate without rotation of said upper die assembly and said lower die assembly; and moving one of said upper die assemblies and said lower die assemblies not secured to said collector plate in registration with said movement of said collector plate.

6. The method for adjusting an axial displacement of a roller die assembly according to claim 5, said method further comprising the steps of:

controlling said drive mechanism with a motor and an encoder device.

7. The method for adjusting an axial displacement of at least two roller die assemblies according to claim 5, said method further comprising the steps of:

forming one of said upper die assemblies and said lower die assemblies not secured to said collector plate to include an eccentric bearing sleeve.

8. A variable width roll forming apparatus for progressively forming a web of material directed therethrough, said roll forming apparatus comprising:

a first side plate extending substantially an entire length of said roll forming apparatus;

a second side plate extending substantially an entire length of said roll forming apparatus, said first side plate and said second side plate being oriented on opposing sides of an axis of movement of said web substantially equidistant from one another;

a plurality of roller die assemblies disposed in apertures formed in said first side plate and said second side plate, said roller die assemblies each include an upper die assembly and a lower die assembly;

an adjusting apparatus for selectively changing a separation width between predetermined roller die assemblies in said first side plate and said second side plate, said adjusting apparatus includes a collector plate fixed to one of said upper die assembly and said lower die assembly disposed in one of said first side plate and said second side plate, wherein said roll forming apparatus defines thereby at least two differing widths between roller die assemblies disposed in said first side plate and said second side plate while maintaining said substantially equidistant spacing between said first side plate and said second side plate; and wherein operation of said adjusting apparatus causes said collector plate to move in a direction substantially orthogonal to said one of said first side plate and said second side plate.

9. The variable width roll forming apparatus according to claim 8, wherein:

said roller die assemblies each include an upper die assembly and a lower die assembly;

said adjusting apparatus includes a collector plate fixed to one of said upper die assembly and said lower die assembly of two roller die assemblies disposed in one of said first side plate and said second side plate; and wherein operation of said adjusting apparatus causes said collector plate to move in a direction substantially orthogonal to said one of said first side plate and said second side plate.

10. The variable width roll forming apparatus according to claim 8, wherein:

said roller die assemblies each include an upper die assembly and a lower die assembly;

said adjusting apparatus includes a first collector plate fixed to one of said upper die assembly and said lower die assembly of two roller die assemblies disposed in said first side plate, and a second collector plate fixed to said upper die assembly and said lower die assembly of two roller die assemblies disposed in said second side plate.

11. The variable width roll forming apparatus according to claim 10, wherein:

said first collector plate and said second collector plate are mounted in opposition to one another on either side of said axis of movement of said web.

12. The variable width roll forming apparatus according to claim 10, wherein:

said adjusting apparatus includes a first drive mechanism for operatively linking said first collector plate to said first side plate, and a second drive mechanism for operatively linking said second collector plate to said second side plate.

13. The variable width roll forming apparatus according to claim 12, wherein:

said first drive mechanism and said second drive mechanism each include a motor and encoder device.

14. The variable width roll forming apparatus according to claim 10, wherein:

said first drive mechanism and said second drive mechanism include a common motor and encoder device.

15. The variable width roll forming apparatus according to claim 13, wherein:

said first drive mechanism and said second drive mechanism each include a jack screw assembly.

16. The variable width roll forming apparatus according to claim 8, further comprising:

a cam block assembly secured to said collector plate;

a first cam roller operatively fixed to one of said upper die assembly and said lower die assembly not fixed to said collector plate, said cam roller being slidably received in a groove formed in said cam block assembly; and wherein operation of said adjusting apparatus causes said cam roller to move along said groove, thereby causing one of said upper die assembly and said lower die assembly not fixed to said collector plate to move in registration with said one of said upper die assembly and said lower die assembly fixed to said collector plate.

17. The variable width roll forming apparatus according to claim 8 wherein:

one of said upper die assembly and said lower die assembly not fixed to said collector plate includes an eccentric bearing sleeve.

* * * * *